US005194297A

United States Patent [19]

Scheer et al.

[11] Patent Number: 5,194,297

[45] Date of Patent: Mar. 16, 1993

[54] SYSTEM AND METHOD FOR ACCURATELY DEPOSITING PARTICLES ON A SURFACE

[75] Inventors: Bradley W. Scheer, San Jose; Paul A. Konicek, Santa Clara, both of Calif.

[73] Assignee: VLSI Standards, Inc., Mountain View, Calif.

[21] Appl. No.: 846,202

[22] Filed: Mar. 4, 1992

[51] Int. Cl.[5] ..... B05D 1/12

[52] U.S. Cl. ..... 427/180; 118/308; 118/689; 118/691; 118/712; 427/424

[58] Field of Search ..... 427/10, 180, 424; 118/308, 688, 689, 690, 691, 712; 356/38, 243; 377/10

[56] References Cited

U.S. PATENT DOCUMENTS 4,477,187 10/1984 Pettit et al. ..... 356/335

OTHER PUBLICATIONS

B. R. Locke et al., "Particle Sizing Uncertainties in Laser Scanning of Silicon Wafers", *Journal Electrochemical Society*, Jul. 1987, vol. 134, No. 7, pp. 1763-1771.

*Primary Examiner*—Shrive Beck

*Assistant Examiner*—Terry J. Owens

*Attorney, Agent, or Firm*—Schneck & McHugh

[57] ABSTRACT

A particle deposition system having an atomizer, wafer transport, sheath flow means, particle counter and computer control for accurately depositing a desired density of particles onto a surface. The sheath flow keeps an article clean, while the particle flux in the deposition chamber is rising from zero to an equilibrium state. The particle counter measures particle flux by sampling the atmosphere in the deposition chamber. The computer determines when the rate of change of particle flux is substantially zero and then actuates transport of the article completely or partially out of the sheath flow into the mist of falling particles. The computer also calculates the required deposition time for providing the article's surface with a desired particle density, actuating transport of the article back into the sheath flow after the desired density is reached. The operator of the system can specify particle size, desired density and full or partial coverage of the surface with particles. The particles can be polystyrene latex reference spheres or real contaminant types for use in calibration wafers for surface scanners.

14 Claims, 3 Drawing Sheets

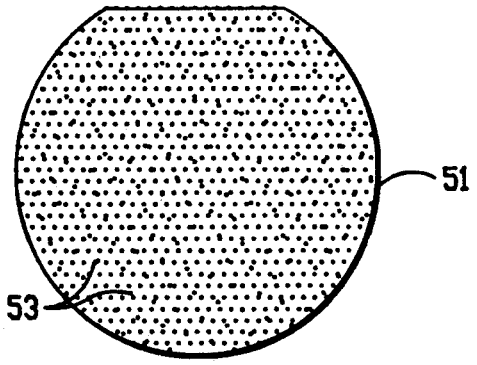
FIG.-3A
FIG.-3B
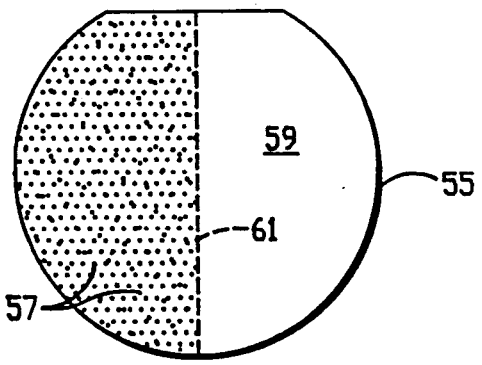
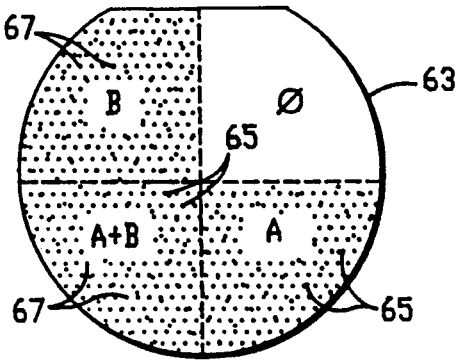
FIG.-3C
FIG.-5
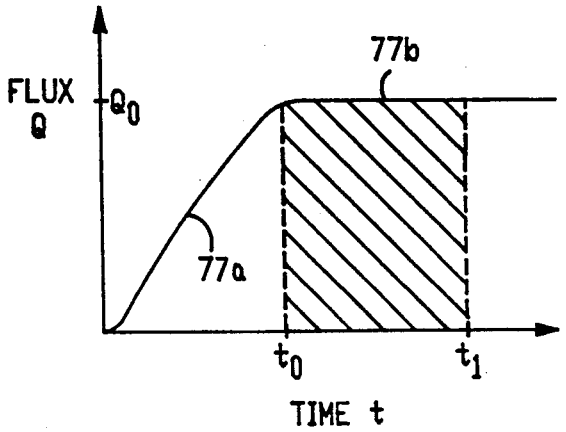

SYSTEM AND METHOD FOR ACCURATELY DEPOSITING PARTICLES ON A SURFACE

DESCRIPTION

1. Technical Field

The present invention relates to systems and processes for uniformly distributing solid particles on a surface, and in particular to systems and processes that employ an atomizer to discharge dry solid particulate material as a mist of separate particles suspended in a stream of gas into a deposition chamber over an extended application area.

2. Background Art

Particle deposition systems are commonly used to deposit polystyrene latex reference spheres onto bare silicon wafers for use in calibrating wafer scanning equipment. Typically, such particle deposition systems comprise a deposition chamber into which a wafer may be placed, and an atomizer, also called a nebulizer, for discharging particles into the chamber for a time period needed to achieve a desired density of particles or particle count on the wafer. Currently available systems work by manually placing a wafer in the deposition chamber at an application area beneath the atomizer's discharge nozzle, and turning on the atomizer. The atomizer then produces a mist of particles that settle onto the wafer. The atomizer is turned off by the operator after some specified time period. The wafer is removed from the chamber and examined to see whether the desired density of particles on the wafer has been achieved. The desired particle density is obtained by trial and error, adjusting the deposition time until a wafer with that density is the result.

Unfortunately, the particle flux in the chamber changes with time, rising from zero at atomizer turn on to a maximum value determined by the gas and particle flow out of the atomizer's discharge nozzle, at some time $t=t_0$ later which is determined, in part, by the particle size. This particle flux rise curve is also strongly a function of atomizer pressure and the density of the colloidal suspension of particles, in addition to particle size. This makes the determination of required deposition time for a desired particle density not very accurate, since the flux generally does not rise linearly with time, and the flux-time curve is not very well characterized, especially for particle types other than polystyrene latex spheres. Further, the actual deposition time provided by manually operated deposition systems is not very precise. Because the rise curve is relatively steep, a small difference in actual deposition time can lead to a much greater difference in the resulting particle density on the wafer. The operation is therefore not exactly repeatable. Since surface scanners can respond differently to different types of real contaminant particles and different types of surfaces, it is desirable to be able to deposit any kind of particle, of any size onto any kind of surface to a desired particle density with sufficient accuracy to be used in calibrating surface scanners It is an object of the invention to provide a particle deposition system and method of depositing particles on surfaces, which is capable of achieving controlled depositions to a density specified by an operator.

DISCLOSURE OF THE INVENTION

The above object is met with a particle deposition system that includes, in addition to the atomizer, wafer transport and computer of prior systems, a particle counter sampling the atmosphere in the deposition chamber for providing a measure of the particle flux through the chamber, a clean area beneath a perforated plate for providing a clean gaseous sheath flow over the article to keep it free from particles, and computer control over the wafer transport and other elements in the system to delay moving the article into the application area of the deposition chamber until the particle flux provided by the atomizer, as monitored by the computer, has reached an equilibrium or steady state.

The wafer transport receives an article with a surface to be deposited with the particles and conveys the article to a clean area. At the clean area, a clean gas sheath flow is provided over the surface of the article, thereby preventing deposition of particles onto the surface. An atomizer discharges particulate material into a top portion of the deposition chamber in the form of a mist of separate particles, typically dry solid particles, suspended in a gaseous stream, such that the particles fall or diffuse with a substantially uniform distribution onto an extended application area near the bottom of the deposition chamber. A particle counter continuously measures the particle flux in the deposition chamber, transmitting the measured flux information to a counter input of the system's computer. The computer processes this received information, calculating a time rate of change of the measured particle flux, and determines when this time rate of change is substantially zero. At this time the flux in the deposition chamber has reached an equilibrium and will remain substantially constant until the atomizer is turned off. Once this equilibrium condition is reached, the computer sends a control signal to the wafer transport to actuate conveyance of the article out of the sheath flow at the clean area into the mist of falling particles at the application area. Particles are thus deposited onto the surface of the article. The article can also remain partially in the sheath flow, moving only partially into the mist of particles, for partial coverage of its surface. The computer also calculates from the measured particle flux and the desired particle density previously specified by the operator a deposition time needed to obtain the desired density. Because deposition occurs only while the flux is in a steady state, the calculation is a simple function of particle flux and particle size, that may be stored in a read only memory of the computer, divided by the desired density. After the article has been in the application area for the required deposition time, the computer again sends a control signal to the wafer transport to actuate conveyance of the article back into the sheath flow at the clean area. The article can then be removed from the system. Additional articles can be deposited with particles while the flux is still in the steady state, or the atomizer can be turned off.

An advantage of this system and method is that the characterization of the rise in flux with time is not needed. At equilibrium, the flux is substantially the same throughout the deposition chamber, and calculation of the required deposition time is simple.

BRIEF DESCRIPTION OF THE DRAWINGS

FIGS. 3A, 3B and 3C are top plan views of wafer surfaces after they have been deposited with particles by the system in FIGS. 1 and 2.

FIG. 5 is a graph of measured particle flux Q versus time t for the deposition system in FIGS. 1 and 2 from the time when the atomizer is turned on.

BEST MODE FOR CARRYING OUT THE INVENTION

Figure 1:
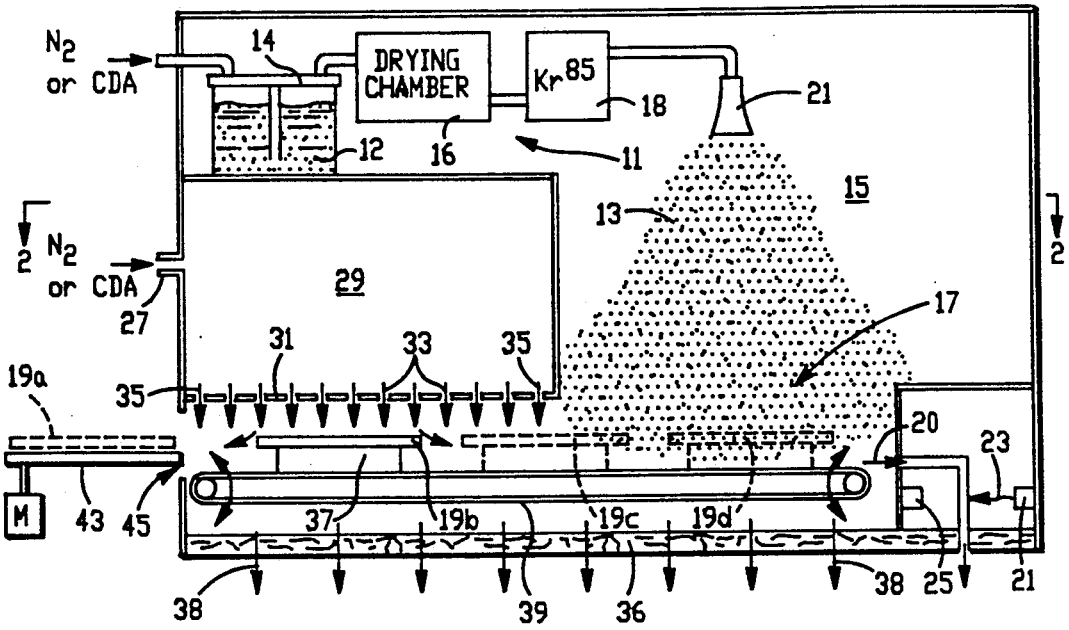
FIG. 1 is a side interior view of a particle deposition system of the present invention.
Figure 2:
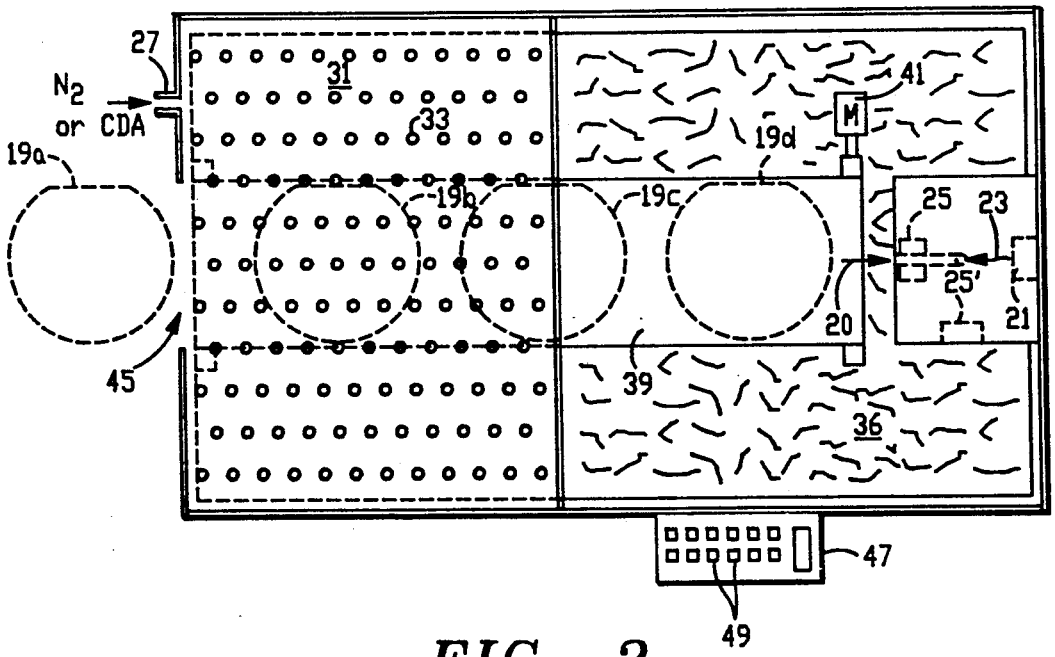
FIG. 2 is a top internal plan view of the system of FIG. 1 seen along the line 2—2 in FIG. 1.

With reference to FIGS. 1 and 2, a system is seen that is capable of providing controlled depositions of small particles onto surfaces. This system includes an atomizer 11 for discharging a fine mist of particles 13 into a deposition chamber 15. The particles 13 fall or diffuse in the deposition chamber 15 over an extended application area 17 near the bottom of the deposition chamber 15, where an article 19 with a surface to be deposited with the particles 13 could be located. The atomizer 11 is a standard commercial device, widely used in the aerosol industry. It is sometimes called a "nebulizer". One commercial supplier of atomizers is TSI, Inc. of St. Paul, Minn. Typically, the particles are solid particles carried in suspension in a liquid, such as deionized water or isopropyl alcohol, from a supply vessel 12 to an aerosol generator 14 that sprays the liquid suspension as very fine droplets into an aerosol drying chamber. If the drying chamber 16 has a large internal surface area, very low particle densities are possible. The solid particles, now dry through evaporation of the liquid carrier medium, are made electrically charge neutral by conditioning them in a conditioner 18 with a beta-emitter, such as Kr-85, in order to keep the particles from being electrostatically attracted to one another and sticking to one another. The beta-emitter is also commercially available from TSI, Inc. The particles are discharged from a nozzle 21 into the chamber 15, the resulting mist is made up of separate dry solid particles suspended in a gaseous stream. Preferably, the particles are uniformly distributed over the application area 17 so that the deposition will be substantially uniform. The particles could also be liquid droplets of an oily material, such as dioctyl phthalate, or a liquid monomer or a salt solution.

Particles distributed in this fashion are typically polystyrene latex spheres, preferably satisfying the NIST standard for reference spheres used for calibration wafers. Such spheres are commercially available from Duke Scientific of Palo Alto, Calif., Japan Synthetic Rubber Co., Ltd. and other vendors. Particle diameters ranging from 0.1 μm to 4.0 μm are typical for use in the semiconductor industry. Polystyrene latex spheres on silicon wafers have well characterized optical responses, making them valuable in calibrating surface scanning equipment used by the semiconductor industry. Alternatively, particles 13 can be real contaminant types, such as $SiO_2$, SiC, $Al_2O_3$, $Fe_2O_3$ and Al beads, granules or powder.

The article or object whose surface is to have particles deposited onto it is typically a bare silicon wafer. However, any substrate, such as patterned wafers, photomasks, optical disks (coated or uncoated) and magnetic disks (coated or uncoated), could be used. The substrate need not have a perfectly planar surface. For example, the patterned wafers are characterized by surface contours that are optically significant.

It should be noted that particles 13 deposited on the surface of an article 19 by the atomizer 11 do not normally form a continuous film coating, like paint pigments, but preferably remain discrete particles, separate from one another on the surface. The particles are randomly scattered over the entire area of the surface, preferably with a substantially uniform distribution. The system of the present invention is intended to ensure accuracy of the actual deposited particle density on the surface, relative to the desired particle density specified by the operator or user of the system.

The system also includes a laser-based, airborne particle counter, essentially comprising a laser source 21 producing a collimated light beam 23, and a light detector or detector array 25. In a preferred configuration, the particle counter continually samples the atmosphere within the chamber through an inlet 20 beneath the substrate location **19*d*, using a collimated light source 21, such as a laser, and a light detector or detector array 25, to provide a measure of particles per unit volume per unit time. The detector 25 is placed in a location relative to the beam 23 to detect either the obscuration of the beam 23 by each particle 13 that crosses through the beam's path or, preferably, the scattering of the light off of the illuminated particles 13 (at location 25' in FIG. 2). In either case, the result is to provide a particle count representative of the flux of the particles 13 falling through the deposition chamber 15. Such volume sampling particle counters are commercially available from TSI, Inc., Particle Measuring Systems, Inc. of Boulder, Colo. and other vendors. Typical steady state flux values provided by the atomizer 11**, as measured by the particle counter, range from 10 particles/0.1 cfm for large particles of about 4 μm diameter to about 500,000 particles/0.1 cfm for small particles of about 0.1 μm diameter. (0.1 cfm=47.195 $cm^3\ sec^{-1}$).

The system further includes a manifold having a gas inlet 27, a chamber 29 and a perforated plate 31 forming the bottom wall of the chamber 29 with many openings 33 therein for providing a clean gas, sheath flow (represented by arrows 35) over the surface of the article 19, whenever the article 19 is in the position **19*b* under the perforated plate 31. The clean gas received by inlet 27 may be dry nitrogen ($N_2$), air or any other inert gas. The gas is typically conditioned and heavily filtered through 0.01 μm filters to remove any suspended particles. The gas flows through the openings 33 and around substrate 19*b*, thereby keeping any particles 13 in the deposition chamber 15 away from its surface. Typically, the surface of the article 19 to be kept clean is positioned less than 1 mm away from the openings 33 in the perforated plate 31, such that the gas flow 35 is confined to the immediate surface of the article 19 by the small gap between the article and the plate 31. When the article 19 is only partially beneath the perforated plate 31, as for example at position 19*c*, the gas flow 35 keeps particles 13 away from the portion of the surface of the article 19 which lies immediately beneath the perforated plate 31, while allowing particle deposition onto the exposed area of the surface in deposition chamber 15. A particle filter 36, such as a HEPA filter, at the bottom of the deposition chamber 36 permits the excess gas 38 from both the sheath flow 35 and the particle-suspended stream of gas forming part of the mist of particles 13**, to exit the system.

The article 19 may be transported by any wellknown wafer transport apparatus known in the semiconductor art. In FIGS. 1 and 2, the article 19 is represented as being conveyed from one position to another on a vacuum chuck 37 seated on a belt-type transport 39 driven by a servo motor 41. However, many kinds of wafer transports, using movable arms and other mechanisms, are well-known and commercially available. A standard commercial wafer handler 43 may be used to place the article 19 through a door 45 onto the system's wafer chuck 37 or other transport beneath the perforated plate 31.

The system also includes a computer 47 for controlling the deposition process so that a specific particle density on the surface desired by the user of the system is obtained with great accuracy and precision. The computer 47 includes a keyboard 49 or other input device to receive user specified information, such as the size of the particles in the atomizer 11, the desired particle density or count and the desired coverage of particles on the article surface (full or half coverage). The computer 47 is also connected to the particle counter, such as to the detector 25 or a processor chip in the particle counter, in order to receive the measured particle flux information. The computer 47 is further connected to the wafer transport equipment, such as to motor 41, to control actuation of that equipment and conveyance of the article from one position to another. Such process control computers are well known and 35 commercially available. The computer's operation is directed by computer software, and will be described further below with references to FIG. 4.

FIGS. 3A–3C show some of the various possible surface depositions that can be specified by a user. In FIG. 3A, a wafer 51 has particles 53 distributed substantially uniformly over its entire surface. Such full coverage can be provided by placing the wafer 51 entirely within the extended application area 17 at position **19*d* in FIGS. 1 and 2, so that the wafer is completely out of the sheath flow 35 under perforated plate 31. Once the wafer 51 is removed from the deposition chamber 15, it looks essentially like that seen in FIG. 3A. In FIG. 3B, a wafer 55 has particles 57 distributed substantially uniformly over about half of its surface, while the other half of the wafer surface is an area 59 that is substantially free of particles. Such half coverage can be provided by placing the wafer 55 partially within the application area 17 and partially under the perforated plate 31 at position 19*c* in FIG. 2, so that the exposed area in the deposition chamber 15 can receive a deposition of particles while the area under the perforated plate 31 is kept free of particles by the sheath flow 35 of clean gas. The boundary (represented by dashed line 61 in FIG. 3B) between the two areas corresponds to the limit of sheath flow over the wafer surface. Due to the small gap of less than 1 mm separating the wafer from the perforated plate 31, the boundary is relatively sharp. FIG. 3C shows a wafer 63 whose surface is the result of two half coverage depositions with the wafer oriented during the second deposition at a right angle to its orientation during the first deposition. The quadrant area $\phi$ is substantially free of particles, since it was under the perforated plate 31 during both depositions. The quadrant area A has a first density of particles 65, while the quadrant area B has a second density of particles 67 or a different size of particle. In the latter case, the atomizer particle size is changed while the wafer is rotated 90°. The quadrant area designated "A+B" was in the application area 17 during both depositions, and therefore has received both a first density of particles 65 during the first deposition and an additional second density of particles 67 during the second deposition. Typically, the densities for both depositions will be the same and only the particle sizes will vary, so that the quadrant A+B will have particles of both sizes deposited thereon. Alternatively or in addition, the particle density may change. Other patterns of particles, besides those shown in FIGS. 3A–3C**, could be formed.

Figure 4:
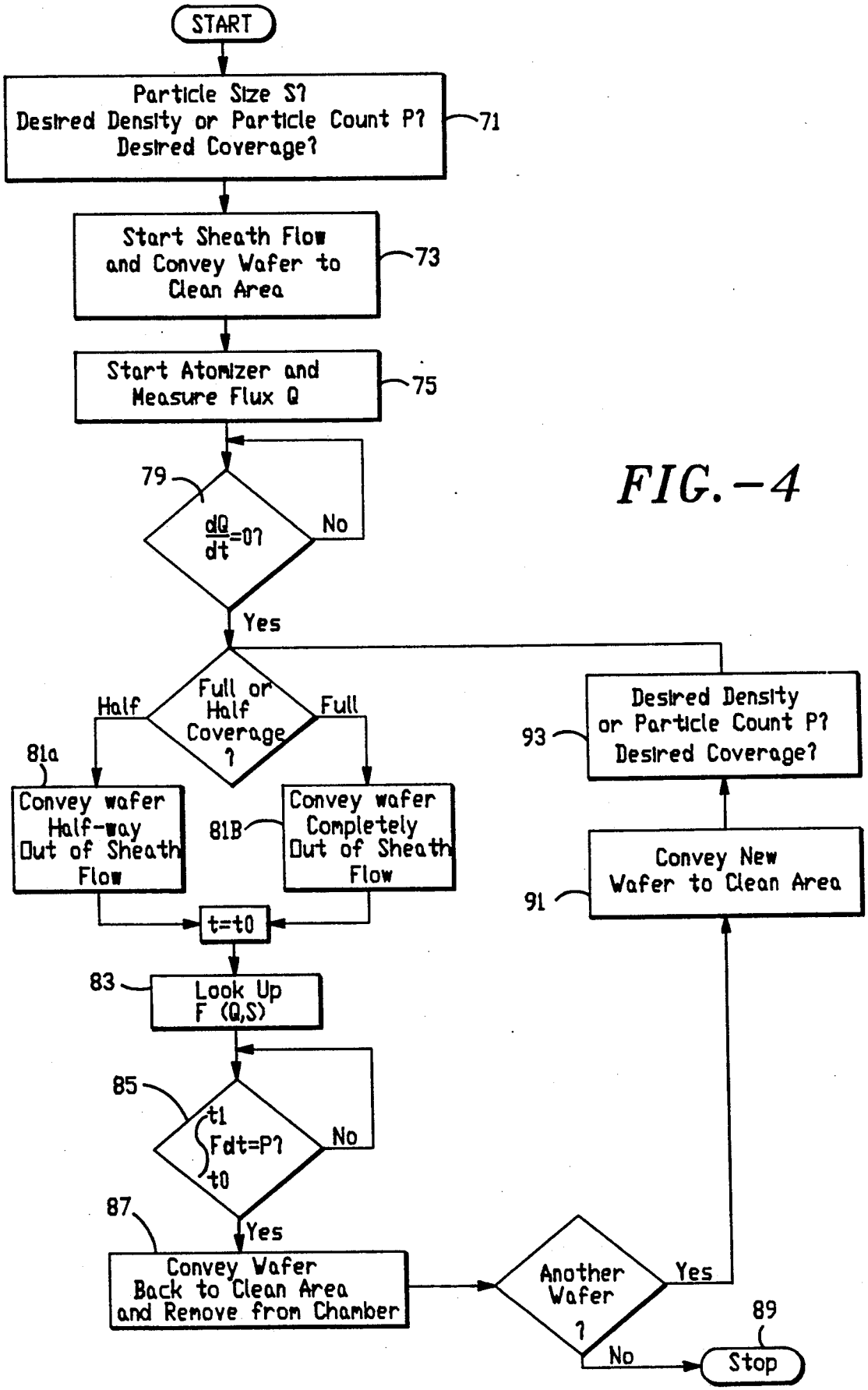
FIG. 4 is a flow diagram of the process steps of the present invention.

With reference to FIG. 4, the computer 47 in FIG. 2, under the direction of computer software, coordinates and controls the deposition process carried out by the system seen in FIGS. 1 and 2. First, the computer prompts the operator of the system for information relating to the intended deposition (Step 71). In particular, the operator might provide information about the size S of particles in the atomizer's supply hopper, information indicating the desired particle density or particle count P to be provided on the article surface and information about the desired surface coverage, e.g. whether full or half coverage is desired.

Next, the sheath flow of clean air or other inert gas is started, a wafer or other article is received from a wafer handler at the position **19*a*, and conveyed by the wafer transport to the clean area under the sheath flow at the position 19*b* seen in FIGS. 1 and 2. (Step 73) Computer control of gas flow can be accomplished by connecting a computer output line to a valve between the gas supply and inlet 27 that is actuated by a control signal received on that computer output line. Computer control of wafer conveyance may be through a second computer output line to the commercial wafer transport equipment in order to actuate motor 41**.

Next, the atomizer is turned on, and the particle counter is likewise turned on so as to continuously measure the flux of particles in the deposition chamber. (Step 75) For this purpose, computer output control lines connect to the atomizer 11 and particle counter elements 21 and 25 to start their operation at the appropriate time. The atomizer then discharges particulate material 13 into a top portion of the deposition chamber 15 in the form of a mist of separate particles suspended in a gaseous stream. The particles 13 in the mist fall or diffuse with a substantially uniform distribution over an extended application area 17 near the bottom of the deposition chamber 15. The previously initiated sheath flow of clean air over the surface of the article 19 prevents deposition of the particles 13 onto the surface at this time. The measurement of the particle flux Q provided by the particle counter is transmitted to a counter input of the computer 47 over a data line.

FIG. 5 shows a typical rise curve for the measured particle flux Q in the deposition chamber 15 from an initial time ($t=0$) when the atomizer 11 is first turned on. The first part of the curve **77*a* represents a nonlinear rise in flux Q up to an equilibrium flux level $Q_0$ at a time $t=t_0$. The rise time $t_0$ varies according to the particle size, typically ranging from 45 seconds to 5 minutes. It also depends on the density of the material that makes up the particles 13, and to some extent the size of the chamber and the placement of the particle counter. Because its shape is determined only for polystyrene latex spheres and a few other particle species, the system of the present invention keeps the article surface in the sheath flow 35 under the perforated plate 31 during this time period, so that inaccurate particle densities will not result. After the flux Q has reached the equilibrium flux level $Q_0$ at time $t=t_0$, the deposition onto a surface in the application area 17 will occur at a substantially constant rate dependent principally upon the flux level $Q_0$ and particle size S. It is for this steady state region 77*b* of the curve that the computer 47** looks.

Returning to FIG. 4, the computer 47 calculates the slope $\phi = dQ/dt$ or time rate of flux increase of the measured flux Q received from the particle counter, determining when the slope is substantially zero, within a preset threshold. (Step 79) Once a steady state condition ($dQ/dt=0$) has been reached, the computer initiates conveyance of the article out of the sheath flow 35 and into the application area 17 by signalling the wafer transport equipment. The final position 19*c* or 19*d* of the article is either half-way out of the sheath flow (Step 81*a*) or completely out of the sheath flow (Step 81*b*) depending on the desired coverage previously entered by the operator of the system. The time of wafer conveyance $t=t_0$ is stored by the computer 47 for reference.

The rate of particle deposition F (Q,S) can be read from a table of values stored in computer memory or ROM that relates this deposition rate to the measured flux value $Q_0$ and the particle size S. (Step 83) The table can be constructed by a systematic compilation of measured particle densities for different equilibrium flux and particle size values onto test wafers, using a surface scanner that has been calibrated with standard test surfaces made by another method. Once the particle deposition rate F is known, the particle density P(t) on the surface currently being deposited with particles is simply $$P(t) = \int_{t_0}^{t_1} F dt,$$

which for stable particle fluxes $Q=Q_0$ becomes $P(t)=F\cdot(t_1-t_0)$. The deposition time T is equal to $t_1-t_0$. Once P(t) is determined to have reached the desired particle density P previously entered by the operator (Step 85) at a time $t_1=t_0+(P/F)$, the article is conveyed back to the clean area at position 19*b* under the perforated plate, again by actuating the wafer transport equipment with a computer control signal. (Step 87) It may then be removed from the deposition chamber to position 19*a* by the wafer handler 43.

If no other wafers are to be deposited at this time, the system is turned off (Step 89) by turning off the atomizer 11, particle counter and sheath flow. However, if additional wafers are to be deposited or a previously deposited wafer is to receive a second deposition (as in FIG. 3C) the "new" wafer is received from the wafer handler and conveyed by the system's wafer transport equipment to the clean area 17*b*. (Step 91) The desired density or particle count P and desired coverage is either received from the operator at this time or read from the computer memory storing previously entered user information. (Step 93) The wafer is then conveyed into the application area 17 as for the first wafer. (Step 81*a* or 81*b*) The flux $Q_0$ is still at equilibrium, so no waiting is needed for second and subsequent articles to be moved into the application area 17. However, changing particle size requires that the atomizer 11 be turned off, allowing time for the mist of particles 13 of the first size to settle before turning the atomizer 11 back on to discharge a mist of particles of a second size.

We claim:

1. A particle deposition system comprising atomizer means for discharging particulate material into a top portion of a deposition chamber in the form of a mist of separate particles suspended in a gaseous stream, said particles in said mist falling with a substantially uniform distribution onto an extended application area near the bottom of said deposition chamber, particle counter means for continuously measuring particle flux in said deposition chamber, transport means for receiving an article with a surface to be deposited with said particles and conveying said article between a clean area of said deposition chamber and said extended application area, means for providing a clean gas sheath flow over said surface of said article when said article is at said clean area, said sheath flow preventing deposition of particles onto said surface, and process control means, having a user input for receiving user specified information including a specified particle density on said surface, a counter input receiving said measured particle flux from said particle counter means and a transport output for actuating said transport means, said process control means also including processor means for calculating a time rate of change of said measured particle flux, determining a time $t_0$ when said time rate of change is substantially zero, and calculating a deposition time T from said measured particle flux and said specified particle density, said process control means for actuating said transport means at said time $t_0$ to convey said article to said application area and for actuating said transport means at a time $t_0+T$ to convey said article back to said clean area.

2. The system of claim 1 wherein said particle counter means includes a laser providing a beam and a detector positioned relative to said laser to indicate the passage of particles through said beam.

3. The system of claim 2 wherein said particle counter means samples said atmosphere in said deposition chamber.

4. The system of claim 1 wherein said means for providing a sheath flow includes a source of clean gas, a clean air chamber with a gas inlet for receiving said clean gas, and a perforated plate at the bottom of said clean air chamber through which said clean gas may pass, said perforated plate being located immediately above said clean area.

5. The system of claim 4 wherein said transport means conveys said article to said clean area such that said surface of said article is less than one millimeter beneath said perforated plate.

6. The system of claim 1 wherein said user specified information includes a specified coverage of said surface, said transport means being actuatable by a control signal from said process control means to convey said article completely out of said sheath flow and completely into said mist of particles if said specified coverage is full coverage, and said transport means also being actuatable by another control signal from said process control means to convey said article only partially out of said sheath flow and partially into said mist of particles if said specified coverage is partial coverage.

7. The system of claim 1 wherein said user specified information includes a size of said particles, said processor means determining a deposition rate from said measured particle flux and said particle size, said processor means calculating said deposition time T by dividing said deposition rate by said specified particle density.

8. The system of claim 1 further comprising filter means at an outlet on a bottom of said deposition chamber for filtering excess gas from said deposition chamber.

9. The system of claim 1 wherein said particles in said gaseous stream in said deposition chamber are dry solid particles.

10. A method of depositing particles on a surface of an article comprising (a) receiving information specified by a user, said information including at least a specified particle density P for particles to be deposited onto a surface, (b) receiving an article having a surface to be deposited with particles and conveying said article to a clean area of a deposition chamber, (c) providing a clean gas sheath flow over said surface of said article, (d) discharging particulate material into a top portion of said deposition chamber in the form of a mist of separate particles suspended in a gaseous stream, said particles in said mist falling with a substantially uniform distribution over an extended application area near the bottom of said deposition chamber, said clean gas sheath flow over said surface of said article at said clean area of said deposition chamber preventing deposition of said particles onto said surface, (e) continuously measuring particle flux in the mist of particles in said deposition chamber by means of a particle counter, (f) calculating from said measured particle flux a time rate of change of said particle flux and determining a time $t_0$ when said time rate of change is substantially zero, (g) conveying said article out of said sheath flow at said clean area into said mist of falling particles at said application area at said time $t_0$, particles in said mist thereby being deposited onto said surface, (h) calculating, from said measured particle flux $Q_0$ and said specified particle density specified by said user, a deposition time T needed to obtain said specified particle density, and (i) conveying said article out of said mist of falling particles at said application area back into said sheath flow at said clean area at a time $t_1 = t_0 + T$.

11. The method of claim 10 wherein said particle flux is measured by sampling the atmosphere in said deposition chamber, said sampling producing a particle count per unit volume per unit time which is representative of said particle flux.

12. The method of claim 10 wherein said user specified information includes a specified coverage of said surface with said particles, said conveying of said article out of said sheath flow and into said mist of particles being only partial if partial coverage is specified, but said conveyance being completely out of said sheath flow and into said mist if full coverage is specified.

13. The method of claim 10 wherein said user specified information includes a size S of said particles, said required deposition time T being calculated from a deposition rate F (Q,S), which is a known function of particle flux Q and particle size S stored in a system memory, and said desired particle density P, such that $T = P/F(Q_0,S)$.

14. The method of claim 10 further comprising repeating steps (g)–(i) for additional articles.

* * * * *